United States Patent [19]

Tesch et al.

[11] 4,309,829

[45] Jan. 12, 1982

[54] PARTICLE INJECTION SYSTEM FOR A FLUID BED DRYER

[75] Inventors: William Tesch; Michael H. Lavallee, both of Milwaukee, Wis.

[73] Assignee: Universal Foods Corporation, Milwaukee, Wis.

[21] Appl. No.: 132,270

[22] Filed: Mar. 20, 1980

[51] Int. Cl.[3] ..... F26B 3/08

[52] U.S. Cl. ..... 34/10; 34/57 A; 99/474; 99/483; 426/473

[58] Field of Search ..... 34/57 R, 57 A, 57 D, 34/10; 426/467, 471, 473, 582; 425/207, 208; 99/474, 483, 453

[56] References Cited

U.S. PATENT DOCUMENTS

| | | | |
|---|---|---|---|
| 1,574,617 | 2/1926 | Gallagher | 34/57 R |
| 3,040,439 | 6/1962 | Frost | 34/57 A |
| 3,313,035 | 4/1967 | Crawford et al. | 34/57 D |
| 3,505,085 | 4/1970 | Straughan et al. | 425/208 |
| 3,849,900 | 11/1974 | Dale et al. | 34/57 D |
| 4,102,056 | 7/1978 | Angelo et al. | 34/57 A |
| 4,109,019 | 8/1978 | Moore | 426/471 |

*Primary Examiner*—Larry I. Schwartz

*Attorney, Agent, or Firm*—Neuman, Williams, Anderson & Olson

[57] ABSTRACT

A particle injection system for a fluid bed dryer includes a product injection tube inserted into a product containing fluid bed chamber of the dryer for injecting particulate material in a fluidized stream into the chamber of the fluid bed dryer while the dryer is in operation.

5 Claims, 2 Drawing Figures

PARTICLE INJECTION SYSTEM FOR A FLUID BED DRYER

BACKGROUND OF THE INVENTION

1. Field of the Invention

This invention relates to fluid bed dryers and more particularly concerns a process and apparatus for injecting particles of material into a fluid bed dryer.

2. Description of the Prior Art

Fluid bed dryers are used for drying particulate material by passing streams of fluidizing gases through a bed of material in a so-called fluidizing chamber. These chambers are usually separate removable units, frequently cylindrical in form and have perforate or screen-like bottom portions which have holes sufficiently small to retain the particulate material while permitting air or other fluid to flow therethrough. Fluid bed dryer operation involves passing sufficient air or other fluid through the chamber to suspend solid particles in a stream of air. If each particle is bathed with a stream of fluid such as air to produce the so-called "fluid bed", uniform drying throughout the entire mass is achieved and critical product qualities can be preserved.

Product loading operations of prior art fluid bed dryers are typically batch operations which involve the removal of the fluidizing chamber from the dryer, filling the chamber with particulate material, and replacing the chamber into the dryer. For some types of product, e.g., cheese and yeast, the individual particles readily adhere to one another and tend to agglomerate in the fluidizing chamber before the chamber can be returned to the dryer and the dryer activated. Problems of localized heavy air streams being channelled through the fluid bed chamber, product matting and non-uniform drying are increased by product agglomeration.

Of particular interest to agglomeration problems is an improved fluid bed dryer as disclosed in U.S. Pat. No. 3,849,900. The improved fluid bed dryer of this patent is characterized by the use of a rotating apertured disc positioned below and out of contact with the product to be dried. The disc delivers streams of air moving in rotary fashion throughout the fluidizing chamber. This improved drying apparatus provides a mixing or agitation action in a fluidized bed of particulate material contained within the fluidizing chamber to free or break up particles which have agglomerated. The apparatus of the above-identified patent also eliminates localized heavy streams of air which tend to develop in the fluidizing chambers of prior art dryers and avoids mechanical agitation and contact with the particles which is undesirable for products that tend to crush, smear or agglomerate.

Although the rotating disc dryer is a notable improvement over prior art fluid bed dryers, it only partially overcomes the problem of initial agglomeration which occurs when certain products are loaded into the product containing chamber of the fluid bed dryer in the conventional batch loading step. The initial agglomeration which occurs due to the batch loading of cheese, yeast or other soft particles frequently is not entirely broken up by the agitation in the ordinary operation of the rotating disc dryer. Thus, initial agglomeration results in nonuniformly dried products and a lack of uniformity in the particle size of the product due to the presence of agglomerates even in this improved prior art dryer.

OBJECTS OF THE INVENTION

Accordingly, it is the primary object of the present invention to provide a particle injection system for fluid bed dryers.

It is a specific object of the present invention to reduce the agglomerization of particles of material to be dried in a fluid bed dryer, increase the effective drying of the particles and produce a more uniformly dried product relatively free of agglomerates.

It is another object of the present invention to provide a simple, convenient and effective manner by which material can be loaded into and initially fluidized in a fluid bed dryer.

It is an additional object of the present invention to improve the ease by which the fluid bed drying operation takes place.

These and other objects will become apparent upon consideration of the description which follows.

SUMMARY OF THE INVENTION

The objects of the present invention are achieved by an improvement in a fluid bed dryer which includes means for introducing a product as a fluidized stream of particulate material into a fluid bed dryer while the dryer is operating. The dryer operation creates a reduced or lowered pressure in the dryer chamber. A product injection means is provided, whereby the particles of product material are suspended in an air stream and drawn as a fluidized stream of particles into the fluidizing chamber of the fluid bed dryer. By injecting extruded or granulated material as a fluidized stream of particles directly into the fluidizing chamber of the dryer while the dryer is operating, the individual particulates are surrounded and suspended by the air which is passing through the chamber and tend not to stick to one another. Thus, the present invention greatly reduces the possibility of particle agglomeration and encourages better fluidization and consequently more even or uniform drying of the particulate material.

A process for introducing particulate material into a fluid bed dryer, in accordance with the present invention, is also provided and comprises positioning and sealing a fluidizing chamber into a fluid bed dryer, passing a current of air through the dryer, and injecting the particulate product into the fluidizing chamber while the dryer is in operation.

Advantageously, the direct injection of particulate material upon extrusion or granulation of the material into the fluidizing chamber provides improved performance, more evenly dried product and eliminates the previously required product handling operations necessary to load the fluid bed dryer.

BRIEF DESCRIPTION OF THE DRAWING

The invention will be better understood upon reading the following detailed description of the preferred embodiment with reference to the drawing, in which.

Figure 1:
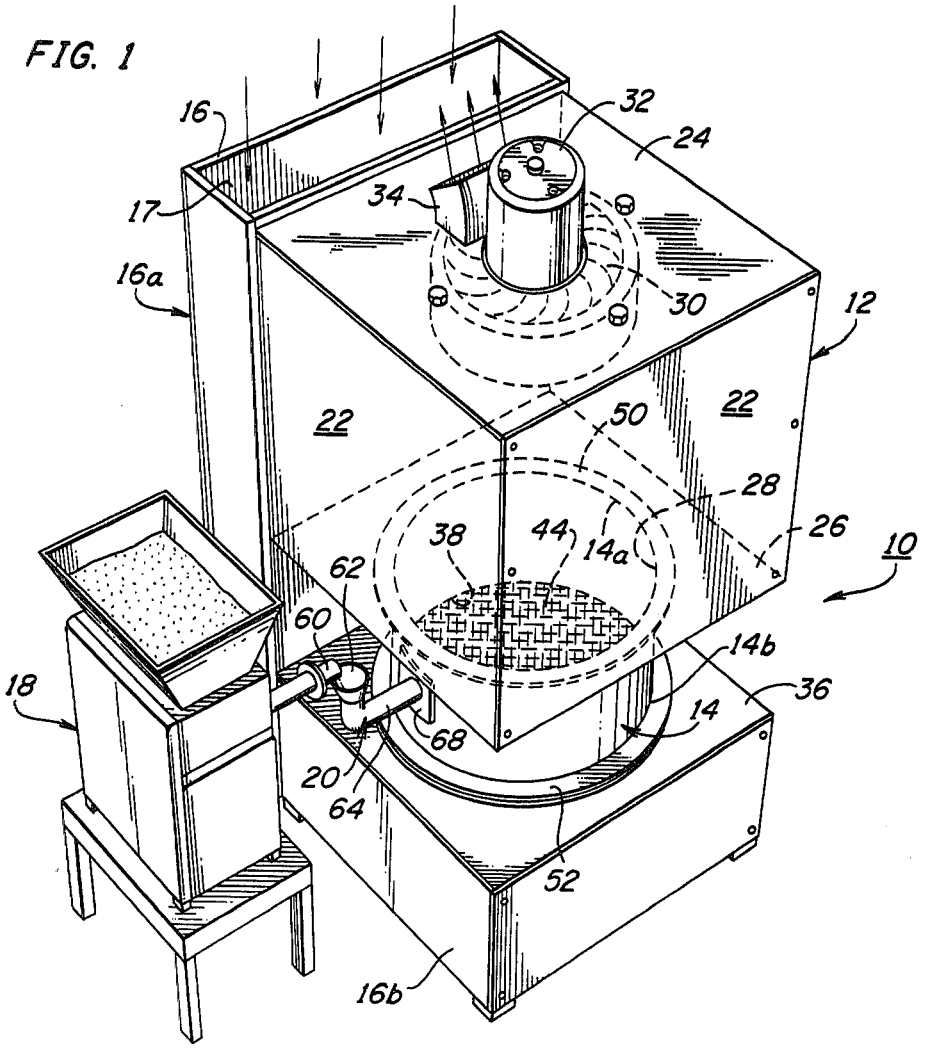
FIG. 1 is a perspective view of an illustrative embodiment of the present invention.

It should be understood that the drawing is not necessarily to scale and that in certain instances, details which are not necessary for an understanding of the present invention or which render other details difficult to perceive may have been omitted.

DETAILED DESCRIPTION OF THE PREFERRED EMBODIMENT

Figure 2:
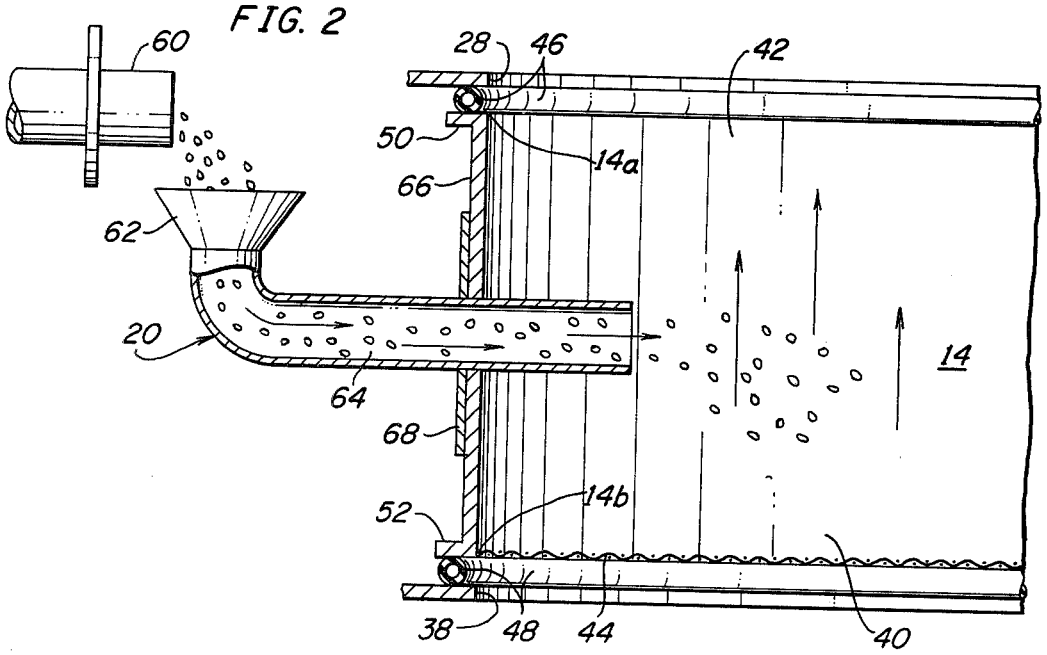
FIG. 2 is a sectional side view of the particle injector of the present invention.

With reference to FIGS. 1 and 2, a fluid bed dryer 10 utilizing the principles of this invention comprises an exhaust plenum 12, a removable product-containing fluid bed chamber 14, an inlet plenum 16, and an injector 20 which is adapted to receive product from an extruder 18 or similar product dispenser or source.

The exhaust plenum 12 is a chamber and in the illustrative embodiment comprises a substantially square-shaped or cubical form defined by sidewalls 22, a top wall 24, and a bottom wall 26. The bottom wall 26 has a circular opening 28 which is aligned with a top edge 14*a* of the chamber 14 to permit air flow through the chamber into the exhaust plenum 12. The top wall 24 is adapted to receive an exhaust fan 30 driven by a motor 32 to remove air from the exhaust plenum 12 via the exhaust duct 34.

The air inlet plenum 16 comprises an L-shaped passage of generally rectangular cross-section which has a vertical leg 16*a* for downward passage of air and a horizontal leg 16*b* which are in communication with one another. The upper wall 36 of the horizontal leg 16*b* is provided with a circular opening 38 formed therein which is aligned with a bottom edge 14*b* of the chamber 14 to permit air flow through the chamber 14 from the inlet plenum 16 into the exhaust plenum 12. The bottom wall 26 of the exhaust plenum 12 is spaced apart from and disposed above the top wall 36 of the horizontal leg 16*b* of the inlet plenum 16 by a distance to permit the insertion therebetween of the chamber 14. The circular openings 28 and 38 are sized to essentially match the upper edge 14*a* and bottom edge 14*b* of the chamber 14 respectively. A screen or dust filter (not shown) may be provided in the inlet plenum 16 to remove undesirable particles from the incoming air.

The removable product-containing fluid bed chamber 14 is cylindrical in shape having a sidewall 66 and an air inlet end 40 and an air outlet end 42. Fluid bed chamber 14 is provided with an air permeable screen-like member 44 at the inlet end 40 or the bottom edge 14*b* to retain particulate material within the chamber 14 while permitting air or other fluid to flow through the dryer 10 when the chamber 14 is in place and the dryer 10 is in operation. Chamber 14 is removable from the dryer 10 and rests on tracks or other support means (not shown). The chamber 14 is sealed into place in the dryer 10 by means of inflatable seals 46 and 48 disposed respectively about the circular opening 28 in the bottom wall 26 of the exhaust plenum 12 and the circular opening 38 in the top wall 36 of the horizontal leg 16*b* of the inlet plenum 16. The seals are disposed to abut circular flanges 50 and 52 at the top and bottom of the chamber 14, respectively, when the chamber is in place. The seals 46 and 48 are in the form of rubber toroidal rings and resemble a tire innertube. When the seals 46 and 48 are collapsed, the chamber 14 is readily inserted into or withdrawn from the dryer 10. When the seals are inflated, they exert pressure on the flanges 50 and 52 to maintain the chamber 14 in place within the dryer 10 and seal the space between the chamber 14 and the inlet and outlet plenums of the dryer to minimize leakage of air passing through the dryer 10.

From the preceding description, the general operation of the dryer is evident. When the motor 32 is activated to drive the exhaust fan 30, air is forced from the exhaust plenum 12 creating a lower pressure (or vacuum) therein whereby air is drawn through the dryer entering the air inlet 17 of the inlet plenum 16 as indicated by the downwardly directed arrows in FIG. 1, passes through the vertical leg 16*a* and the horizontal leg 16*b* of the inlet plenum 16 and passes up through the chamber 14 into the exhaust plenum 12 where it is exhausted to the atmosphere through exhaust duct 34 by the fan 30. Accordingly, particulate material contained within the chamber 14 is fluidized and dried by the air flow therethrough.

In accordance with the present invention, the extruder 18 is provided with a cooperating product injector 20 which serves to feed or inject extruded particulate material to be dried into the fluid bed chamber 14. The extruder 18 feeds the injector 20 by means of an extruder nozzle 60 which is positioned over a funnel element 62 of the injector 20. A generally L-shaped injection pipe 64 of the injector 20 receives the funnel element 62 and is inserted through the sidewall 66 of the chamber 14 and supported and sealed in place by the mounting plate 68. During operation of the dryer 10, air is drawn from the exhaust plenum 12 by the fan 30 to create a subatmospheric pressure in the product-containing chamber 14. Since the ambient air surrounding the dryer 10 is at atmospheric pressure, an air flow is established through the injector 20 into the dryer. If granulated or extruded material is introduced into the injector 20 via the funnel element 62, the particles of the material are drawn into the air stream flowing into the dryer 10 and are thereby injected into the chamber 14.

In a typical drying operation, the fluidizing chamber 14 would have been removed from the dryer 10 and the dried material emptied from the chamber. The empty chamber 14 is then repositioned within the dryer 10 and sealed into place by inflating the seals 46 and 48. The motor 32 is activated to drive the fan 30 to draw air through the dryer 10 and to create the pressure differential between the chamber 14 and the outside ambient atmospheric pressure to activate the injector 20. Product, such as cheese or yeast, to be extruded and dried is inserted into the extruder 18 which is activated to feed extruded material out the extruder nozzle 60 and into the funnel element 62 of the injector 20 where the particulate material is injected into the chamber 14 by the air flow through the injection pipe 64. After the chamber 14 is filled to a desired level by the action of the extruder 18 and the injector 20, the dryer remains in operation until the product is appropriately dried at which time the dryer is deactivated and the product is removed from the chamber 14. The injector 20 can be plugged by a suitable plug (not shown) after the chamber is loaded to enhance the dryer operation.

As is apparent from the above description, the injector system of the present invention provides a continuous particulate material injection system for a fluid bed dryer to encourage good initial fluidization and reduce agglomeration of the particulate material. This is contrary to prior art fluid bed dryers where particulate material is introduced in bulk into the fluid bed chamber and then the chamber is introduced into the fluid bed dryer. Such prior art fluid bed dryer batch loading operations encourage initial agglomeration of the product and produce lower yields and less uniformly dried product.

While a preferred embodiment of this invention has been described, it will be understood that the invention is not limited thereto. In view of the foregoing teachings, modifications will be apparent to those of ordinary skill in the art to which this invention pertains. Therefore, the appended claims are intended to cover any modification and any other embodiments which constitute the salient features of this invention within the true spirit and scope of the invention.

What is claimed is:

1. In a fluid bed dryer having a fluidizing chamber adapted to contain an easily agglomeratable material in particulate form and means for drawing a current of air through said fluidizing chamber to fluidize and dry said material and create a subatmospheric pressure within said fluidizing chamber, the improvement comprising: injector means for injecting said particulate material in a confined fluidized stream into said fluidizing chamber, said injector means comprising a short tubular element inserted into and communicating with said fluidizing chamber and terminating external to said fluidizing chamber in a funnel shaped collection means open to the ambient atmosphere surrounding said fluid bed dryer wherein said particulate material is introduced into said funnel shaped collection means and transferred into said fluidizing chamber by an air pressure differential between said fluidizing chamber and said collection means so that said particulate material is introduced into said fluidizing chamber in a fluidized state to remain in a particulate form and enhance the drying operation.

2. The improvement in accordance with claim 1 further comprising extruder means for extruding a product into said collection means for injection into said fluid bed dryer in particulate form.

3. Fluid bed apparatus for drying an easily agglomeratable extruded particulate product such as cheese or yeast and comprising:

a fluidizing chamber adapted to contain said easily agglomeratable particulate product;

means for drawing a current of air through said fluidizing chamber to dry said particulate product and create a vacuum within said fluidizing chamber;

inject or means for injecting said particulate product into said chamber, said inject or means comprising a short tubular element inserted into said chamber and a funnel element connected to said tubular element external to said fluidizing chamber with said funnel element being open to the atmosphere for collecting and passing said particulate product into said fluidizing chamber via said tubular element by means of said vacuum; and extruder means for extruding a substantially solid easily agglomeratable product into particulate form and passing said product in particulate form by gravity and air pressure differentials into said funnel element for injection into said fluid bed dryer.

4. A fluid bed dryer comprising:

an air inlet plenum including an air inlet opening and an air outlet opening;

an air exhaust plenum including an air inlet opening and an air outlet opening;

a fan mounted on said exhaust plenum for removing air from said exhaust plenum through the outlet opening of said exhaust plenum;

a product receiving fluid bed chamber having a sidewall, an air inlet formed to correspond to the air outlet opening of said inlet plenum and an air outlet formed to correspond to the air inlet opening of said exhaust plenum, said inlet plenum and exhaust plenum being disposed to receive said chamber therebetween; and a generally L-shaped injector tube inserted through the sidewall of said chamber and including a frustoconical funnel element exterior of said chamber being generally disposed to receive product to be dried in a particulate form by gravity feed whereby operation of said fan creates a subatmospheric pressure within said chamber to draw particulate product suspended in a confined fluidized air stream into said chamber through said injector tube.

5. A process for introducing an easily agglomeratable product into a fluid bed dryer comprising:

(a) positioning a fluidizing chamber within said dryer;

(b) sealing said chamber into said dryer to maintain its position therein and to prevent air leaks therefrom;

(c) drawing a current of air through said dryer and said fluidizing chamber to create a subatmospheric pressure therein;

(d) extruding said easily agglomeratable product into a particulate form;

(e) passing the extruded particulate form of said product directly from the extruder to a short product injection pipe open to the atmosphere so that said particulate form of said product is passed to said injection pipe under the influence of gravity and a fluidizing air stream created by the pressure differential between said chamber and the ambient atmosphere; and (f) injecting the extruded particulate form of said product into said chamber in a confined fluidized stream through said product injection pipe by the pressure differential between said chamber and the ambient atmosphere.

* * * * *